US005810675A

United States Patent [19]

Weathers

[11] Patent Number: 5,810,675

[45] Date of Patent: Sep. 22, 1998

[54] GOLF PUTTING STROKE TRAINING DEVICE

[76] Inventor: Patrick A. Weathers, 1606 Tilden Ave., Fort Wayne, Ind. 46805

[21] Appl. No.: 848,098

[22] Filed: Apr. 28, 1997

[51] Int. Cl.[6] ..... A63B 69/36

[52] U.S. Cl. ..... 473/236; 473/253

[58] Field of Search ..... 473/236, 253

[56] References Cited

U.S. PATENT DOCUMENTS

| | | | |
|---|---|---|---|
| 3,021,141 | 2/1962 | Polsky et al. | 273/194 |
| 3,039,776 | 6/1962 | Faini | 473/236 |
| 3,194,564 | 7/1965 | Swan | 273/186 |
| 4,025,078 | 5/1977 | Pelz | 273/186 A |
| 5,011,153 | 4/1991 | Watkins | 273/186 A |
| 5,135,229 | 8/1992 | Archer | 273/186.2 |
| 5,351,961 | 10/1994 | Eulau | 273/186.2 |
| 5,441,268 | 8/1995 | Shier | 273/186.2 |
| 5,551,695 | 9/1996 | Wolk | 473/236 |

OTHER PUBLICATIONS

Advertisement for DrPutts' Putting Pointer, Apr., 1997 issue of Golf for Women.

Copy of packaging and actual DrPutts' Putting Stroke Perfector.

Information Sheet regarding DrPutts' Putting Stroke Perfector.

*Primary Examiner*—George J. Marlo
*Attorney, Agent, or Firm*—Baker & Daniels

[57] ABSTRACT

A putting stroke training device is removably attached to a putter in a simple one step action. A body of the training device is attached to a conventional putter and includes a C-shaped, resilient attachment member that deforms to fit over the top-line of conventional putters and, by operation of memory of the material, abuts snugly to the back face of the putter in the back cavity. Two parallel alignment guide members extend from the body perpendicularly to the face of the putter. The training device is held in place by operation of the device itself without relying upon some non-integral means for attachment. The two parallel alignment members or fingers, extending perpendicularly from the putter club face, act as a guide between which an individual strikes a golf ball. Many golfers suffer from inconsistent putting strokes in which the putter head may be angled away from the ball on the backstroke and the follow through, resulting in the golf ball leaving the face of the putter head in a direction other than toward the target. The training device of the present invention helps develop a more uniform pendulum-type putting stroke for increased accuracy and consistency in an individual's putting stroke by fostering a one-piece shoulder and arm movement. The parallel fingers provide enhanced visual alignment by "framing" the target path to help give the golfer a feel for the target path and the correct stroke path. The parallel fingers provide instant feedback to the golfer as to whether he or she is taking the putter head back parallel with the target path and whether the head stays perpendicular with the target path during the forward stroke and follow through. The parallel fingers are elevated above the ground or putting surface and the sole of the putter is unobstructed and may be rested directly against the ground or putting surface, i.e., no part of the training device of the present invention comes between the ground and the putter.

7 Claims, 3 Drawing Sheets

GOLF PUTTING STROKE TRAINING DEVICE

BACKGROUND OF THE INVENTION

The invention relates generally to golf equipment, and more particularly, to golf stroke training devices aimed at improving the putting stroke of an individual golfer. The invention relates to training aids designed to be easily attached to and removed from a putter so that the device is not an obstruction during conventional golf play.

Prior putting stroke training devices are disclosed in U.S. Pat. No. 5,011,153 (Watkins), and U.S. Pat. No. 5,351,961 (Eulau). These references illustrate earlier devices directed to aiding individual golfers in improving their putting stroke. Problems associated with such earlier devices are that they are generally difficult to attach and detach from the putter, they are intermediate the sole of the putter and the ground or putting surface, they are obtrusive and appear to add greatly to the weight of the putter, therefore altering the true feel of the putting stroke and making the putter and training device combination awkward to handle, and the devices rely on some additional means, such as rubber bands or Velcro strips, for attaching the training device to the putter.

SUMMARY OF THE INVENTION

According to the present invention, an improved golf putting stroke training device is removably attached to a putter in a simple one step action. The putting aid of the present invention includes a body which is attached to a conventional putter about the top-line of the putter. Two parallel alignment guide members extend from the body at the face of the putter and extend perpendicularly therefrom. The body of the putting training aid includes a C-shaped, attachment member, made of resilient material, such as polyethylene, that deforms to fit over the top-line of conventional putters and, by operation of memory of the material, abuts snugly to the back face of the putter in the back cavity. In this manner, the training device of the present invention is held in place by operation of the device itself without relying upon some non-integral means for attachment.

With the training device securely attached to the putter, the two parallel alignment members or fingers extend perpendicularly from the putter club face to provide a guide between which the individual strikes a golf ball. Many golfers suffer from inconsistent putting strokes in which the putter head may be angled away from the ball on the backstroke and the follow through. Because of the arcuate nature of the putting stroke, the face of the putter is likely to strike the golf ball at a point where the center of the golf ball is off center and not perpendicular to the face of the putter. This results in the golf ball leaving the face of the putter head in a direction other than toward the target.

The training device of the present invention helps develop a more uniform pendulum-type putting stroke for increased accuracy and consistency in an individual's putting stroke by fostering a one-piece shoulder and arm movement. In a proper stance, the face of the putter is perpendicular to the target and the parallel fingers are parallel with a target path, defined as a straight line running through the golf ball to the target, not necessarily the golf hole. As the putter head is drawn back away from the golf ball, the path of the putter should follow the target path in a direction away from the target and generally parallel with the individual's stance. The club should not be pulled back off of this path. During the forward stroke, the putter should follow the target path in a direction toward the target. At the point of striking the golf ball, the putter face should be perfectly perpendicular to the center of the golf ball and the ball should be struck at the sweet spot of the putter. After striking the golf ball, the path of the putter during the follow through should follow the target path. This is a pendulum-type motion that promotes optimum club-ball orientation so that the ball is directed in the intended direction toward the target.

The parallel fingers provide enhanced visual alignment by "framing" the target path to help give the golfer a feel for the target path and the correct stroke path. Throughout the putting stroke, the parallel fingers provide instant feedback to the golfer as to whether he or she is taking the putter head back parallel with the target path and whether the head stays perpendicular with the target path during the forward stroke and follow through. The training device is provided with a midpoint arrow or other indicator so that the training device may be properly aligned with the sweet-spot mark typically found on the top-line of putters. With the training device properly aligned on the putter, the golfer is given a further guide to keep the ball in the exact middle of the parallel fingers to ensure that the sweet-spot of the putter strikes the ball.

The training device of the present invention is easy to attach and detach from the putter. The parallel fingers are maintained at a position somewhat elevated above the ground or putting surface and is designed so as not to strike the ground at any point during the putting stroke. The sole of the putter is unobstructed and may be rested directly against the ground or putting surface, i.e., no part of the training device of the present invention comes between the ground and the putter. The present invention device is unobtrusive and adds little, due the light weight nature of the material used and its relatively small size, to the weight of the putter, and therefore does not appreciably alter the feel of the putting stroke. Accordingly, the present invention is not awkward to handle when attached to a putter. The present invention training device does not rely on any additional means, such as rubber bands or Velcro strips, for attaching the training device to the putter. The present invention is preferably a one-piece integral apparatus that easily attaches to and detaches from a putter.

In one form of the invention, the invention provides a golf putting stroke training aid device which is removably mounted on the head of a putter. The training device is of one-piece construction and has a resilient clamping portion for attaching the training aid to the putter and a pair of parallel fingers. When attached to a putter head, the pair of parallel fingers extend outwardly from and perpendicular to the face of the putter and are spaced apart and elevated above the putting surface.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
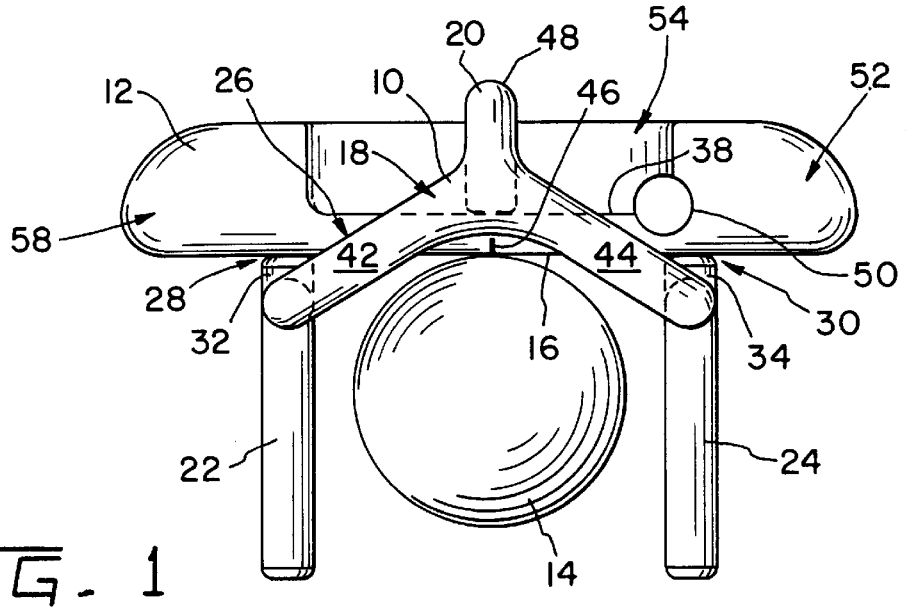
FIG. 1 is a top view of the putting stroke training aid of the present invention attached to a putter club head.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DETAILED DESCRIPTION OF THE INVENTION

Figure 2:
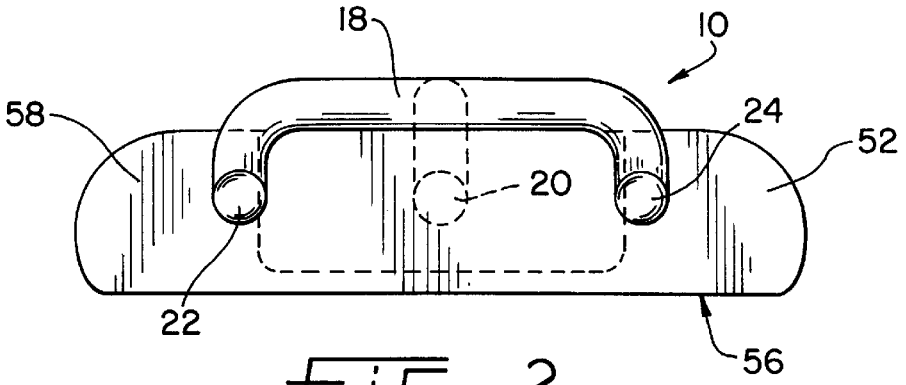
FIG. 2 is a front view of the putting stroke training aid of FIG. 1.
Figure 3:
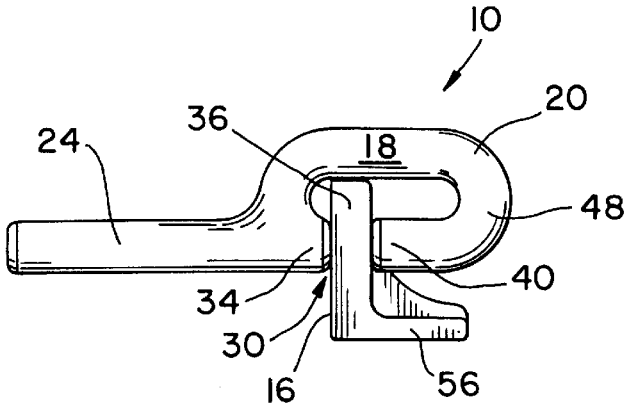
FIG. 3 is a side view of the putting stroke training aid of FIG. 1.
Figure 4:
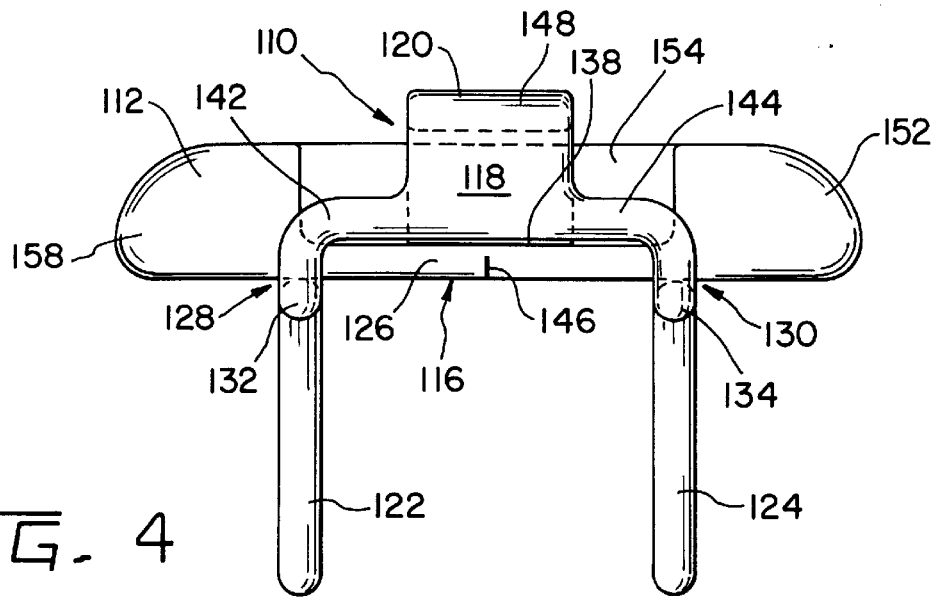
FIG. 4 is a top view of a second embodiment of the putting stroke training aid of the present invention attached to a putter club head.
Figure 5:
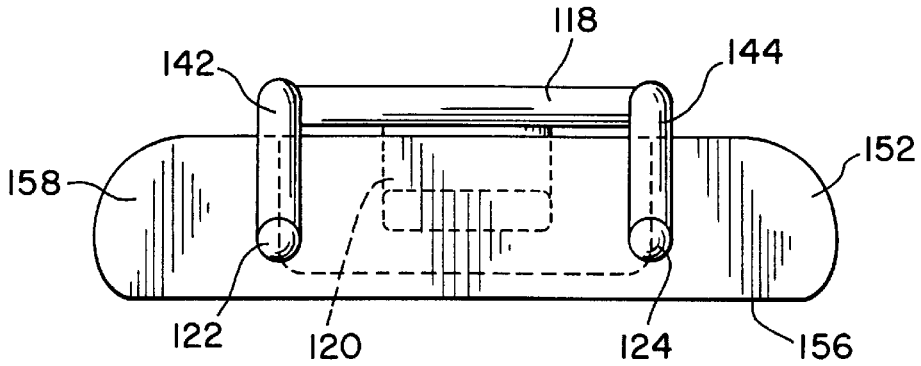
FIG. 5 is a front view of the putting stroke training aid of FIG. 4.
Figure 6:
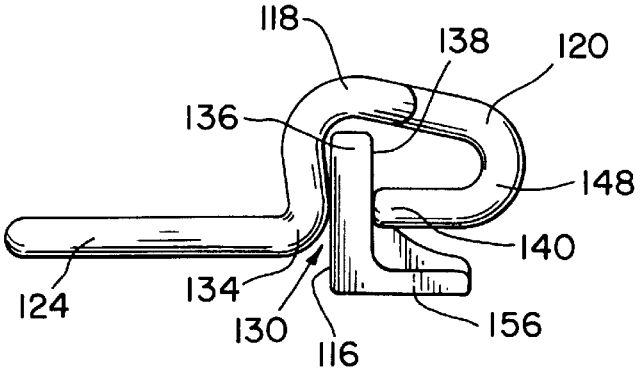
FIG. 6 is a side view of the putting stroke training aid device of FIG. 4.
Figure 7A:
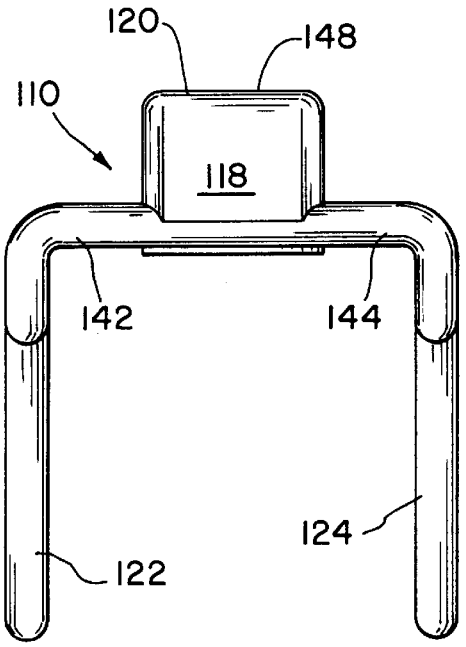
FIG. 7*a* is a top view of the putting stroke training aid device of FIG. 4.
Figure 7B:
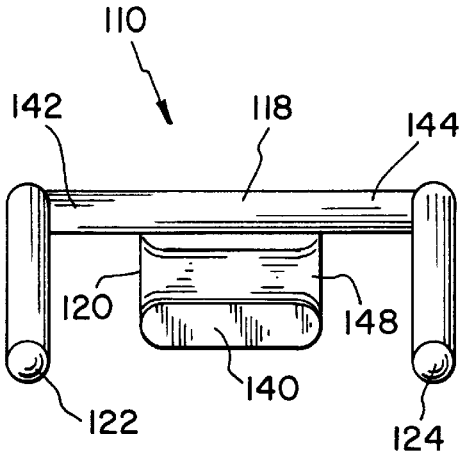
FIG. 7*b* is a front view of the putting stroke training aid device of FIG. 4.
Figure 7C:
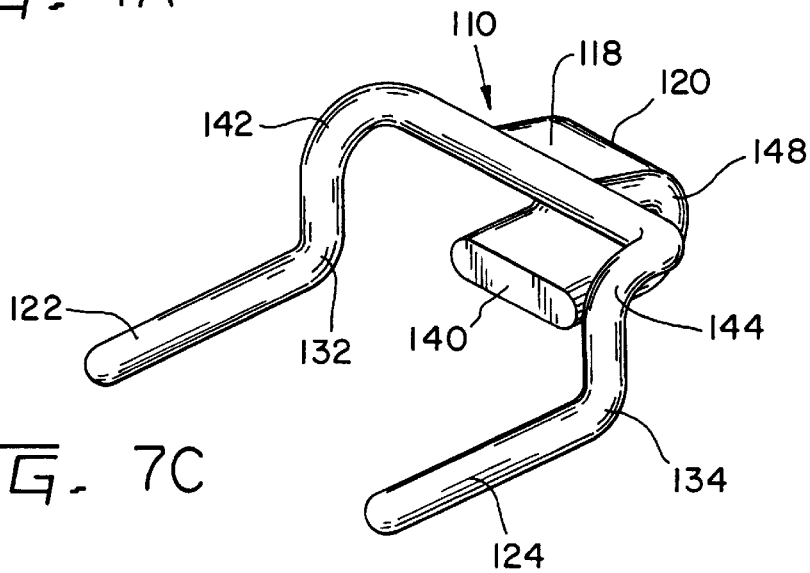
FIG. 7*c* is a side perspective view of the putting stroke training aid device of FIG. 4.
Figure 7D:
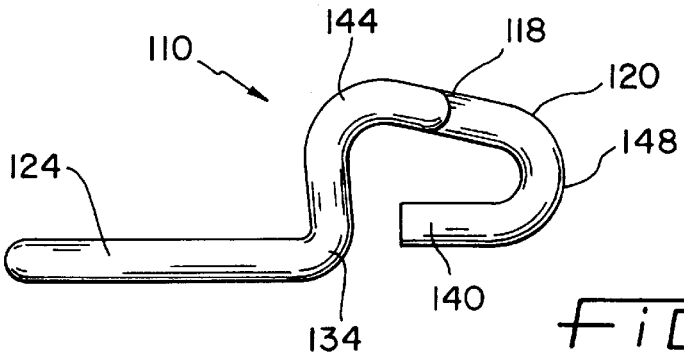
FIG. 7*d* is a side view of the putting stroke training aid device of FIG. 4.

Referring now to the drawings, FIGS. 1–3 illustrate a preferred embodiment of the putting stroke training aid device of the present invention, referenced generally as 10, and FIGS. 4–7*d* illustrate a second embodiment of the putting stroke training aid device of the present invention, referenced generally as 110. With respect to FIGS. 1–3, putting stroke training aid device 10 is shown attached to putter club head 12 with golf ball 14, typically one and ¾ inch in diameter, shown abutting club face 16. Putting stroke training aid 10 is shown having a body 18 from which extends C-shaped clamping portion 20 and parallel alignment guide members or posts or fingers 22 and 24, approximately two inches in length as shown in the figures. With putting stroke training aid device 10 attached to putter club head 12, C-shaped attaching portion 20 surrounds upstanding portion 36 and firmly engages same along club face 16 via inwardly projecting portions 32 and 34 at points 28 and 30 and along back surface 38 by inwardly projecting portion 40.

Body 18 rests upon top line 26 along two angled and outwardly projecting arms 42 and 44 which respectively terminate into outwardly extending parallel guide posts 22 and 24. With arms 42 and 44 resting upon top line 26, which is generally a flat surface parallel with the putting surface, guide alignment posts 22 and 24 are properly aligned to be parallel with respect to the putting surface and perpendicular with respect to club face 16. Generally, putters are provided with a sweet spot indicator 46 which indicates the center of gravity of the putter club head. Downwardly extending curved post portion 48, a trademark, or some other mark or indication is provided along the upper surface of body 18 and is aligned with sweet spot indicator 46 to most effectively align putter stroke training aid device 10 on putter club head 12 to aid the user in striking golf ball 14 perfectly between alignment posts 22 and 24 and in the sweet spot of putter club head 12 for most effective, accurate, and consistent putting stroke performance. By having arms 42 and 44 angle out away from body 18 near club face 16, the putting stroke training aid device 10 may be used on putters in which hozel 50 extends a significant distance inward from heel 52 toward sweet spot indicator 46.

Most modern putters include a back cavity 54 which is defined by sole 56, upstanding portion 36, toe 58, and heel 52. Back cavity 54 provides ample access for attaching portion 20 of putting stroke training aid device 10 to putter upstanding portion 36. Most putters are provided with an upstanding portion 36, the upper surface of which defines top-line 26, having a dimension between ¼ inch in width and ¾ inch in width. At least C-shaped clamping portion 20 of the putting stroke training aid device 10 is made of a resilient material, such as a polymer or copolymer based substance, such as polyethylene, which permits the gap between inwardly extending portions 32, 34 and 40 to be enlarged so as to accommodate the upstanding portion 36 of a given putter club head. A clamping force is exerted by the C-shaped attaching portion 20 which effectively pinches upstanding portion 36 of the putter between inwardly extending portions 32, 34 and 40 of the putting stroke training aid device. The curved nature of the training device in general, and of clamping portion 20 in particular, provides enhanced structural properties which permit the training device to be mounted and dismounted from a putter club head repeatedly without suffering undue wear or structural fatigue. The material selected, such as polyethylene, for the training device must be able to withstand the deflection associated with the mounting and demounting process and maintain a clamping force upon upraised portion 36 of the putter.

With arms 42 and 44 of body 18 resting along top-line 26, gravity helps hold the putting stroke training aid device in place on the putter club head 12. Arms 42 and 44 extend in a divergent fashion along a significant portion of top line 26, thereby helping to prevent putting stroke training aid device 10 from twisting, and keeping alignment guide posts 22 and 24 substantially in a common plane parallel with the putting surface. Should guide posts 22 and 24 become somewhat out of alignment so that they are not in a common plane, the guide posts are nonetheless parallel with the putting surface. During a practice swing, the club head 12 may follow an arcuate path similar to that of a pendulum. Guide posts 22 and 24 are of such a length to ensure that the posts do not come into contact with the putting surface during the putting stroke. It is believed that best performance will be achieved by having guide posts 22 and 24 extend from club face 16 at a height such that golf ball 14 breaks the common plane in which guide posts 22 and 24 lie. However, it is within the contemplation of the present invention that guide posts 22 and 24 may lie in a common plane situated above the putting surface and golf ball 14.

In keeping with the present invention, golf ball 14 strikes club face 16 directly and should never come into contact with putting stroke training device 10. Also in accordance with the present invention, the putting stroke training aid device is attached to the putter club head 12 so that sole 56 is completely unobstructed and rests directly upon the putting surface, i.e., the putting stroke training device does not come between the putter and the putting surface.

Now referring to FIGS. 4–7*d*, an alternative embodiment of the putting stroke training device of the present invention, referenced generally as 110, is illustrated attached to putter club head 112. Putting stroke training aid 110 is shown having a body 118 from which extends C-shaped clamping portion 120 and parallel alignment guide members or posts or fingers 122 and 124. With putting stroke training aid device 110 attached to putter club head 112, C-shaped attaching portion 120 surrounds upstanding portion 136 and firmly engages same along club face 116 via inwardly projecting portions 132 and 134 at points 128 and 130 and along back surface 138 by inwardly projecting portion 140.

Body 118 rests upon top line 126 along arms 142 and 144, which terminate into outwardly extending parallel guide posts 122 and 124, respectively. A first portion of arms 142 and 144 extend outwardly from body 118 parallel with club face 116. A second portion of arms 142 and 144 extends perpendicularly from the first portions, then extends downward toward sole 156, and then, at inwardly projecting portions 132 and 134, respectively, extends perpendicularly from club face 116 outward parallel with the ground or putting surface. Arms 142 and 144 may or may not rest upon top-line 126, which is generally a flat surface parallel with the putting surface. Guide alignment posts 122 and 124 are properly aligned to be parallel with respect to the putting surface and perpendicular with respect to club face 116.

Generally, putters are provided with a sweet spot indicator 146 which indicates the center of gravity of the putter club head. A trademark or other mark or indication along the upper surface of body 118 may be aligned with sweet spot indicator 146 to most effectively align putter stroke training aid device 110 on putter club head 112 to aid the user in striking golf ball 114 perfectly between alignment posts 122 and 124 and in the sweet spot of putter club head 112 for most effective, accurate, and consistent putting stroke performance.

Most modern putters are provided with a back cavity 154 which is defined by sole 156, upstanding portion 136, toe 158, and heel 152. Back cavity 154 provides ample access for attaching portion 120 of putting stroke training aid device 110. Most putters are provided with an upstanding portion 136, which generally include top surface which defines top-line 126, having a dimension between ¼ inch in width and ¾ inch in width. At least C-shaped clamping portion 120 of the putting stroke training aid device 110 is made of a resilient material which permits the gap between inwardly extending portions 132, 134 and 140 to be enlarged so as to accommodate the upstanding portion 136 of a given putter club head. A clamping force is exerted by the C-shaped attaching portion 120 which effectively pinches upstanding portion 136 of the putter between inwardly extending portions 132, 134 and 140 of the putting stroke training aid device. The curved nature of the training device in general, and of clamping portion 120 in particular, provides enhanced structural properties which permit the training device to be mounted and dismounted from a putter club head repeatedly without suffering undue wear or structural fatigue. The material selected, such as polyethylene, for the training device must be able to withstand the deflection associated with the mounting and demounting process and maintain a clamping force upon upraised portion 136 of the putter.

With arms 142 and 144 of body 118 resting along the upper surface of top-line 126, gravity helps hold the putting stroke training aid device in place on the putter club head 112. And with arms 142 and 144 being spaced apart along top-line 126, putting stroke training aid device 110 is deterred from twisting, thereby keeping alignment guide posts 122 and 124 substantially in a common plane parallel with the putting surface. Should guide posts 122 and 124 become somewhat out of alignment so that they are not in a common plane, the guide posts are nonetheless parallel with the putting surface. During a practice swing, the club head 112 may follow an arcuate path similar to that of a pendulum. Guide posts 122 and 124 are of such a length to ensure that the posts do not come into contact with the putting surface during the putting stroke. It is believed that best performance will be achieved by having guide posts 122 and 124 extend from club face 116 at a height such that golf ball 114 breaks the common plane in which guide posts 122 and 124 lie. However, it is within the contemplation of the present invention that guide posts 122 and 124 may lie in a common plane situated above the putting surface and golf ball 114. In keeping with the present invention, club face 116 directly strikes golf ball 114 and should never come into contact with putting stroke training device 110. Also in accordance with the present invention, the putting stroke training aid device is attached to the putter club head 112 so that sole 156 is completely unobstructed and rests directly upon the putting surface, i.e., the putting stroke training device does not come between the putter and the putting surface. The dimensions indicated on the figures are in inches and represent a preferred configuration of the present invention.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A golf putting stroke training aid device in combination with a putter having a club head, said training aid device being removably attachable to said club head and being of one-piece construction, said training aid device comprising a resilient clamp for attaching said training device to said putter, and a pair of parallel posts which extend outwardly from and perpendicular to a face of said club head, said parallel posts being spaced apart and elevated above a putting surface with a sole of said club head resting on the putting surface, a portion of said clamp being substantially C-shaped in cross-section and having an opening for receiving an upstanding portion of said putter head, said opening being narrower at its most narrow point than the thickness of said putter upstanding portion, whereby said clamp exerts a clamping force against said putter to maintain the position of said golf training aid relative to said putter head.

2. The combination putter and training aid of claim 1, wherein said pair of parallel posts fall in a plane that is parallel with the putting surface and crosses the face of the putter.

3. The combination putter and training aid of claim 1, wherein said pair of parallel posts fall outside of a plane that is parallel with the putting surface and crosses the face of the putter.

4. The combination putter and training aid of claim 1, wherein said pair of parallel posts are spaced apart a distance slightly greater than the diameter of a golf ball.

5. The combination putter and training aid of claim 1, wherein said pair of parallel posts are spaced apart a distance substantially greater than the diameter of a golf ball but less than the length of the putter club head.

6. The combination putter and training aid of claim 1, wherein said training device is made of a polymer based substance.

7. A golf putting stroke training aid device in combination with a putter having a club head with a bottom sole, said training aid device comprising a clamp for removably attaching said training device to said putter club head, and a pair of parallel posts which extend outwardly from and perpendicular to a face of said club head, said parallel posts being spaced apart and elevated above a putting surface with a sole of said club head resting on the putting surface, said clamp adapted to attach to said putter from the top of said putter club head so that no portion of said training device is between the sole of the putter and the ground when mounted to said putter, said clamp being substantially C-shaped and forming an opening for receiving an upstanding portion of said putter head, said opening being adjustable, whereby said clamp exerts a clamping force against said upstanding portion of said putter to maintain the position of said golf training aid relative said putter head.

* * * * *